United States Patent [19]

Mills

[11] Patent Number: 4,794,989

[45] Date of Patent: Jan. 3, 1989

[54] WELL COMPLETION METHOD AND APPARATUS

[75] Inventor: Aubrey C. Mills, Houston, Tex.

[73] Assignee: AVA International Corporation, Houston, Tex.

[21] Appl. No.: 796,153

[22] Filed: Nov. 8, 1985

[51] Int. Cl.[4] ..... F21B 33/124

[52] U.S. Cl. ..... 166/387; 166/127; 166/147; 166/187; 166/191

[58] Field of Search ..... 166/120, 122, 123, 127, 166/128, 147, 152, 187, 191, 196, 387, 141, 337

[56] References Cited

U.S. PATENT DOCUMENTS

| | | | |
|---|---|---|---|
| 2,935,133 | 5/1960 | Eckel et al. | 166/141 |
| 3,371,717 | 3/1968 | Chenoweth | 166/147 |
| 3,412,800 | 11/1986 | Kisling | 166/120 |
| 3,517,743 | 6/1970 | Pumpelly et al. | 166/127 |
| 4,393,929 | 7/1983 | Akkerman | 166/120 X |
| 4,519,456 | 5/1985 | Cochran | 166/147 X |
| 4,566,535 | 1/1986 | Sanford | 166/91 X |
| 4,567,944 | 2/1986 | Zunkel et al. | 166/127 |
| 4,569,396 | 2/1986 | Brisco | 166/191 X |
| 4,590,995 | 5/1986 | Evans | 166/127 |

FOREIGN PATENT DOCUMENTS

| | | | |
|---|---|---|---|
| 235230 | 8/1964 | Austria | 166/147 |

OTHER PUBLICATIONS

*Composite Catalog of Oilfield Equipment and Services*, vol. 3, 1982–1983, World Oil, Houston, TX, pp. 3882, 3883, 3983.

*Primary Examiner*—Stephen J. Novosad
*Assistant Examiner*—David J. Bagnell
*Attorney, Agent, or Firm*—Vaden, Eickenroht, Thompson & Boulware

[57] ABSTRACT

There is disclosed apparatus for use in completing oil or gas wells having two or more perforated production zones which includes packers and assemblies for closing off the annular space between the tubing string and the well bore intermediate adjacent zones to isolate one from the other in order to produce from each individually.

6 Claims, 8 Drawing Sheets

WELL COMPLETION METHOD AND APPARATUS

This invention relates generally to apparatus for use in completing oil and gas wells; and, more particularly, to improvements in apparatus for use in completing wells having two or more perforated production zones. In one of its aspects, it relates to improved packers and assemblies for use in closing off the annular space between the tubing string and the well bore intermediate adjacent zones and thereby isolate one from the other in order to produce from each individually. In another of its aspects, it relates to improved apparatus including two or more such packers for use in closing off the annular space between each adjacent pair of three or more such zones in a well.

In the completion of wells of this type, it is often the practice to perforate each of these zones before setting packers between adjacent pairs so as to isolate the zones from one another. There is a problem, however, in testing the packers to be sure that they are properly set—i.e., that their packing elements seal off with the annulas between the tubing string and the well bore. Thus, as compared with other well completions in which there is only one perforated production zone beneath the packer, it's not the practice to apply test pressure to the annulas about the tubing string above the packer because of possible damage to the preforated upper zone.

The primary object of this invention is to provide a packer for this purpose which may be tested without risk of damage to either zone.

More particularly, it is another object of this invention to provide such a packer and assembly in which the packer may be set and then in a single trip.

It is a still further object to provide apparatus for use in completing a well having three or more such zones in at least each of the packers above the lower packer which may be individually tested, and preferably set, in a single trip and with a minimum of wire line manipulation.

These and other objects are accomplished, in accordance with the illustrated embodiment of this invention, by apparatus which includes a well packer comprising a tubular body including a mandrel having a bore therethrough connected as part of the tubing string, packing elements disposed about the mandrel in vertically spaced relation, and means carried about the mandrel for expanding the packing elements into and holding them in sealing engagement with the bore intermediate perforated production zones within the well bore. More particularly, the packer has means which include a test port in the mandrel connecting the mandrel bore with the outside of the packer intermediate the expanded packing elements, whereby the sealing engagement of the packing elements with the well bore may be tested by the introduction of test pressure into the annular space between them which is opposite an unperforated area of the casing and thus without risking damage to either the upper or lower perforated production zones.

In the illustrated and preferred embodiment of the invention, the mandrel and the packing element expanding means form an expansible fluid chamber between them, and the mandrel has another port therein which connects its bore with the chamber so that the packing elements may be expanded in response to the admission of pressure fluid to the chamber. More particularly, and as will be understood from the description to follow, prior to setting and testing the packer, as above described, it's possible to establish circulation through the test port in the same trip.

In the preferred embodiment of the invention, the mandrel bore has a receptacle in its upper end to receive the lower end of a tubing section in sealed relation thereto, and locking elements are carried by the packer for movement into and out of locking engagement with the tubing section. More particularly, and in accordance with another novel aspect of the invention, the mandrel includes means for holding the elements in locking position, as the mandrel is lowered with the tubing section into the well bore, and then releasing them to move out of locking position and thus free the tubing section to be lifted from the receptacle in response to setting of the packer. Thus, each of a plurality of such packers may be individually retrieved and the tubing section above each raised or lowered as desired.

More particularly, the packer is part of an assembly which also includes a pipe string which is disposable within the packer bore and which is sealably engagable with the packer bore, when so disposed, so as to form a path through which test fluid may be passed into and through the port in the mandrel in order to test the sealing engagement of the packing elements. Preferably, the pipe string has upper and lower seal means thereon for sealably engaging the bore of the packer above and below the test port in the mandrel, and a port intermediate the upper and lower seal means through which the test fluid may be passed in order test only that packer. In the preferred and illustrated embodiment, wherein the packer has an expansible fluid chamber to permit it to be set by pressure fluid, the pipe string may be so manipulated as to both set and test the packer in a single trip. Thus, the pipe string is reciprocable between positions in which the seal means thereon isolates the port in the pipe string for communication with the second port in the mandrel to set the packer and then with the first port in the mandrel to test it. Preferably, the pipe string is initially vertically located in a position in which its port is isolated for connection with the test port in the mandrel to permit fluid to be circulated through the first port and past the packing elements before they are expanded. In this way, the operator can be assured that when test pressure is held in the process of testing the packing elements, it results from the fact that the packing elements are sealably engaged with the well bore, and not because of blockage of the test port in the mandrel.

In apparatus for use in completing a well having three or more perforated production zones, a plurality of well packers are so connected by tubing sections that each is adapted to close off the annular space between the tubing string and the well bore intermediate each adjacent pair of the zones. In a well installation of this type, the pipe string is raised within the tubing string for disposable within the bore of a lower and then an upper packer to individually test the sealing engagement of their packing elements with the well bore. In the illustrated well installation, the lower most packer is run and set on a wire line to accurately establish its elevation and thus the elevation of packers above it with respect to the zones, and the packers thereabove are lowered into connection with the lower packer.

When, as illustrated, the zone beneath the lower most packer is perforated, a tail pipe suspended from the lower most packer is closed by a removable standing valve, and the pipe string is so positioned its bore so as to confine test fluid within the pipe string for flow through the test port in the lower most packer. One or more packers above the lower most packer is of the preferred construction previously described having an expansible fluid chamber into which pressure fluid may be introduced through the pipe string in order to expand the packing elements into sealing engagement with the well bore. Thus, following testing of the packing elements of the lower most packer, the pipe string may be raised to a position within the bore of the packer thereabove in order to first set the packer by expanding its sealing elements, and then moved to another vertical position for testing the sealing engagement of its packing elements. More particularly, as in the case of the preferred assembly previously described, the pipe string may initially be disposed in the bore of the packer for circulating pressure fluid through the test port in its mandrel and past the unexpanded packing element.

In the illustrated well installation, there is another packer or third packer connected above the second packer by means of a tubing section, so that the two packers above the lower most packer may be lowered into the well bore with one another. The third packer is similar to the second packer in that it has a expansible chamber by means of which its packing elements may be expanded in response to pressure fluid admitted through the pipe string. Thus, upon testing of the second packer, the pipe string is raised into a position for introducing pressure fluid into the expansible chamber of the third packer for causing its packing elements to be expanded, following which it may then be moved to another vertical position for testing the sealing engagement of the packing elements of third packer. As in the case of the second packer, circulation through the test port of the third packer may be established by disposal of the pipe string in a position for introducing pressure fluid through the test port prior to setting of the packing elements of the third packer.

In the illustrated well installation, there is still another or fourth packer which is connected above the third packer by another tubing section, so that the second, third and fourth packers may be lowered into the well bore together, with the fourth packer being so spaced along the tubing sections as to close off the well bore above the upper most perforated production zone. The pipe string is imperforate intermediate its ends so that it isolates the bores of the second and third packers as well as the test port of fourth packer so that the upper most packer may be set by the pressure fluid in the pipe string following testing of the sealing engagement of the packing elements of the lower most packer. If desired, the sealing engagement of the packing elements of the upper most packer may be tested by pressure fluid within the annulus thereabove since the packing elements sealably engage the well bore above the upper most unperforated production zone. Alternatively, the packing elements may be tested by pressure in the pipe string following testing of the third packer and raising of the test string into sealing engagement with the bore of the upper most packer above and below the test port therein.

In the drawings, wherein like reference characters are used throughout to designate like parts:

Figure 14:
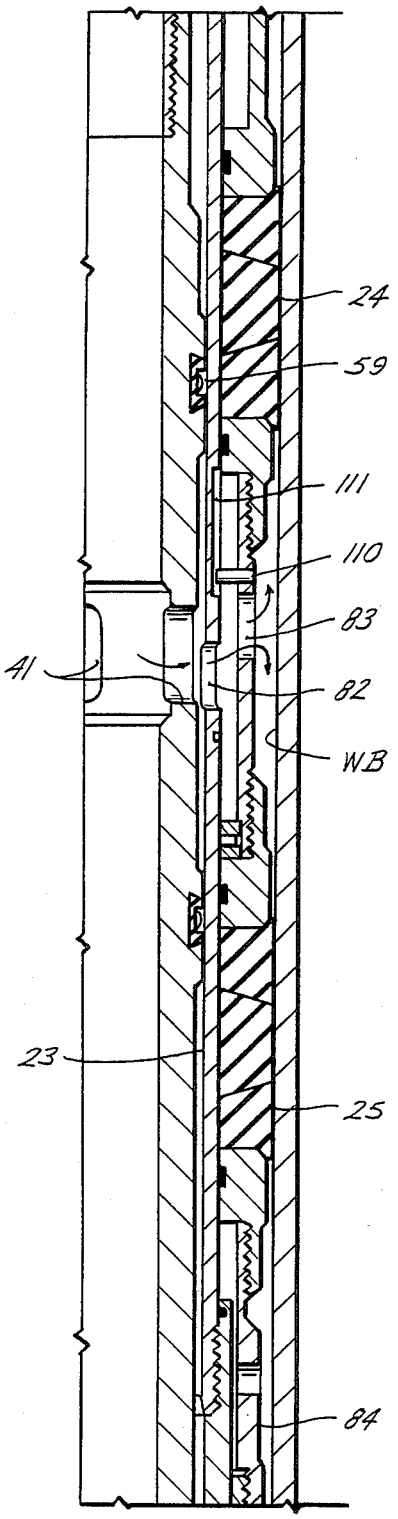
Figure 12A:
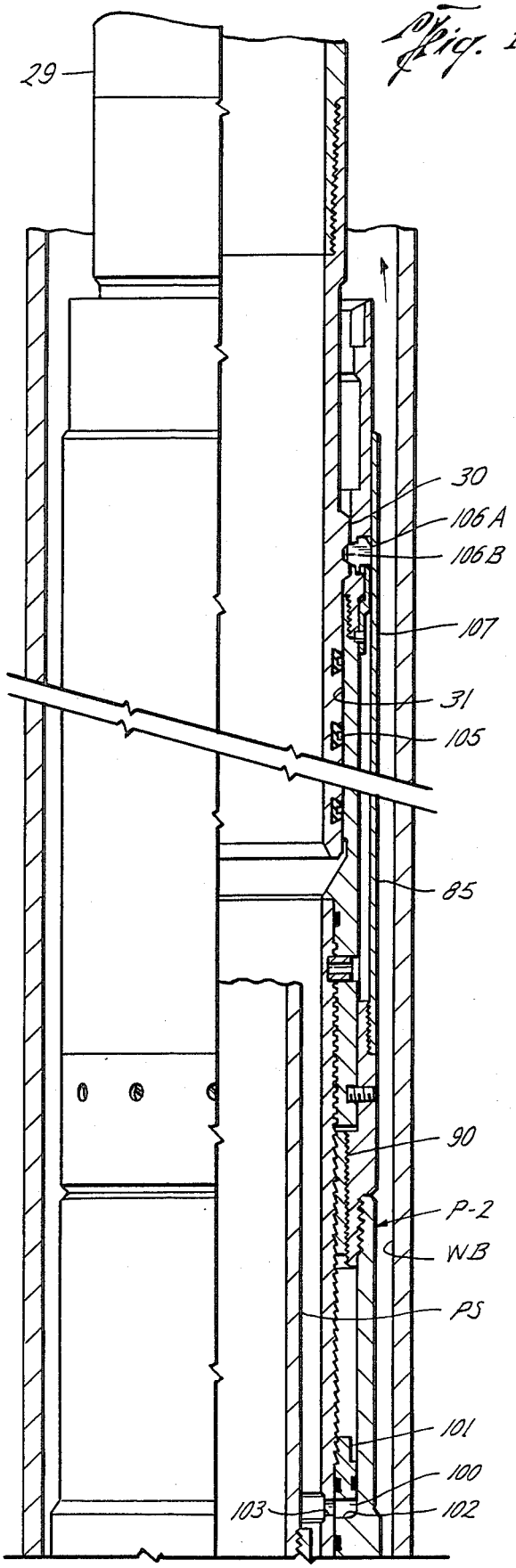
Figure 13A:
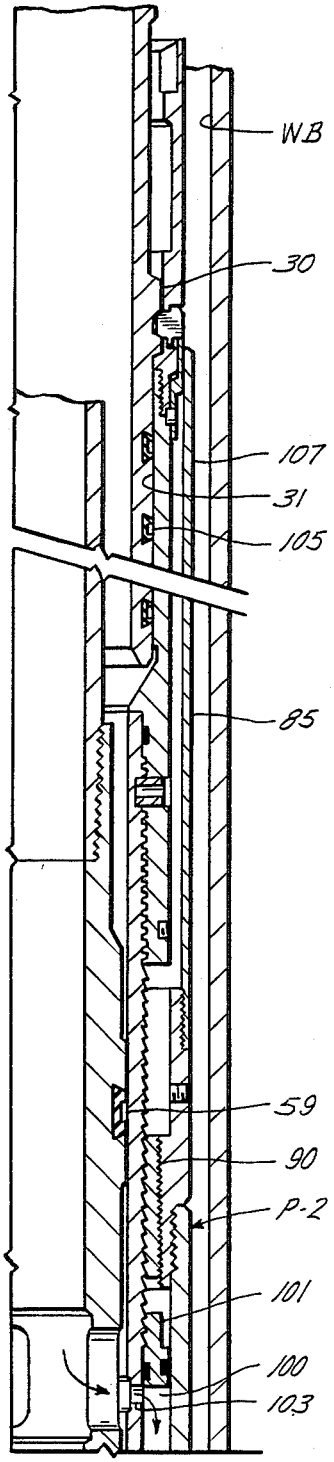
Figure 12B:
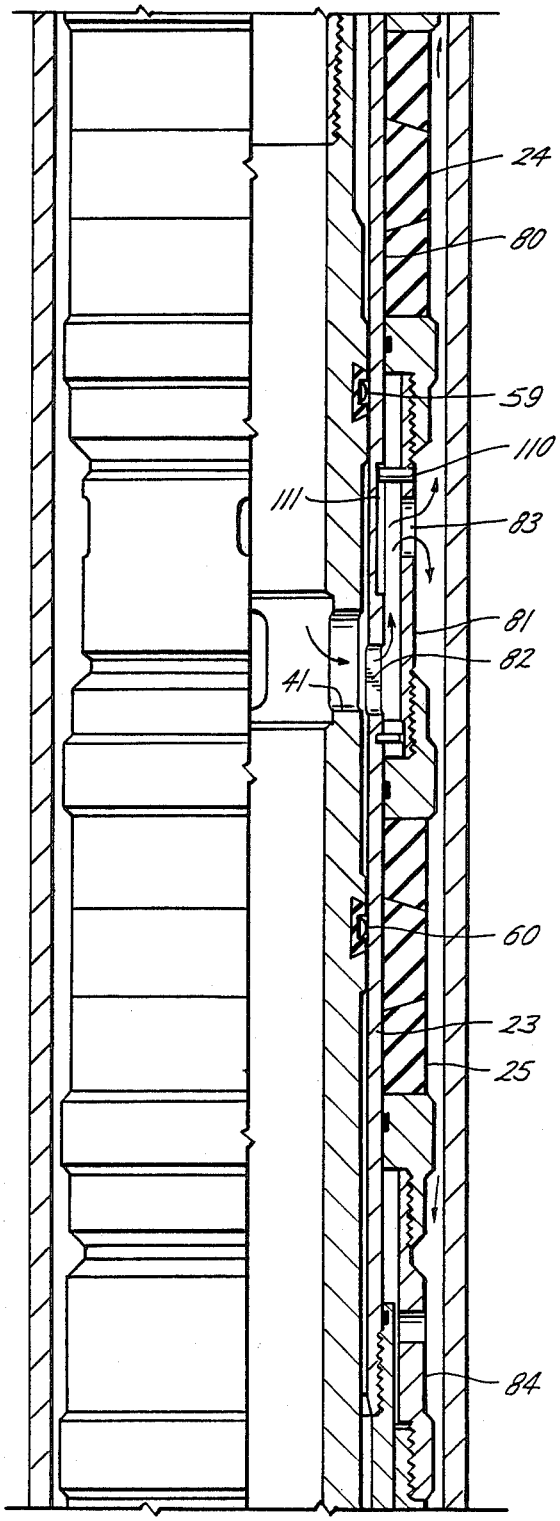
Figure 13B:
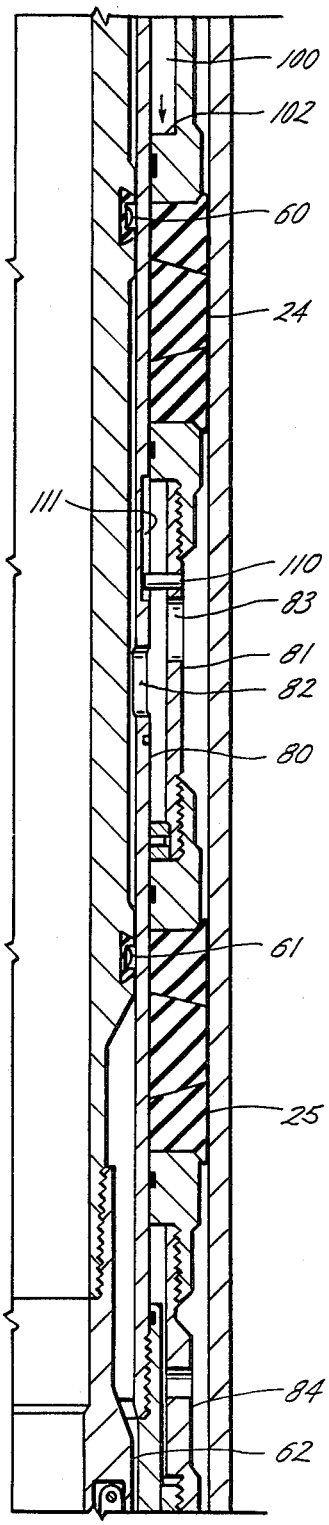
Figure 12C:
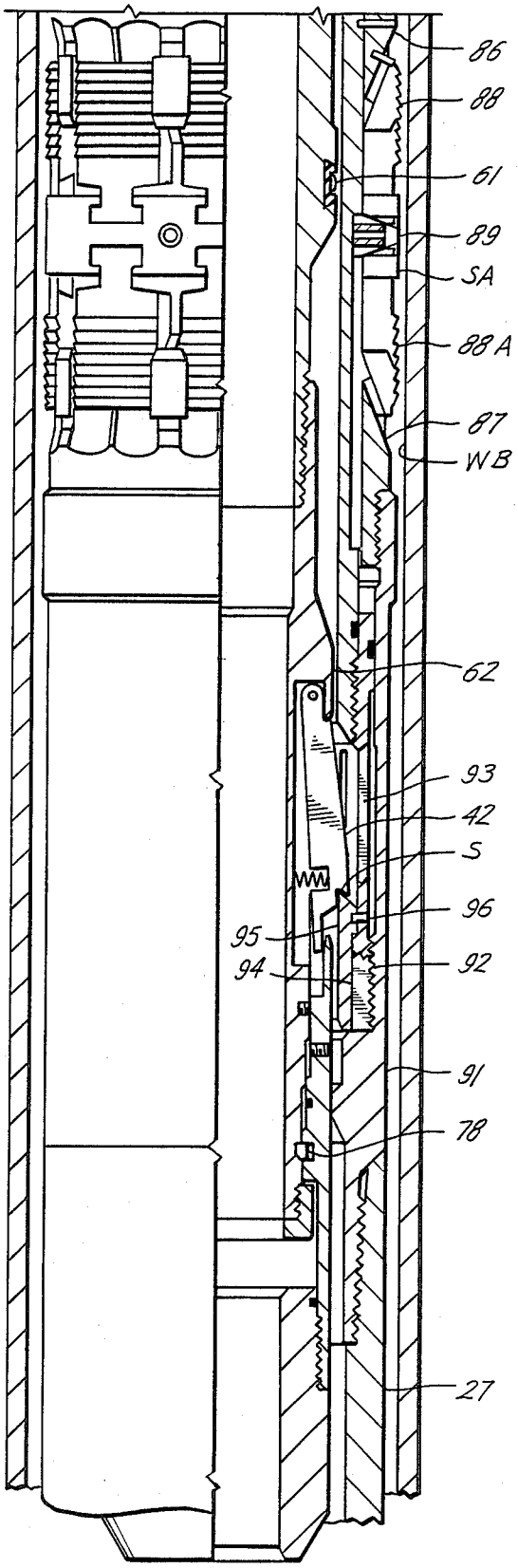
Figure 13C:
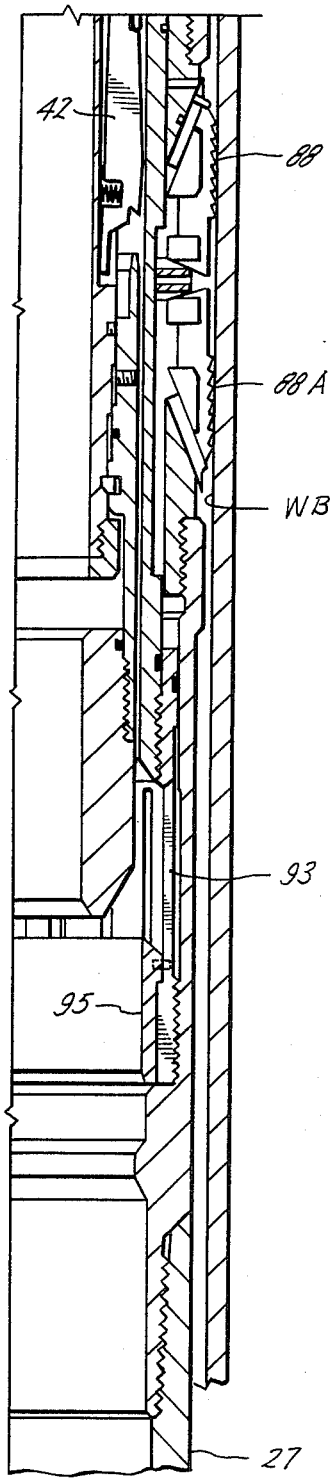

FIGS. 12A, 12B and 12C are views, partly in section, of the upper, intermediate and lower portions of the second packer, with the packing elements in retracted position within the well bore, and the pipe string thereof positioned to dispose its port in position to establish circulation and through the test port in the mandrel and past the packing elements of the packer, FIGS. 13A, 13B and 13C are views of the packer and pipe string, similar to FIGS. 12A, 12B and 12C, but upon repositioning of the pipe string to dispose its port in a position connecting with the mandrel port leading to its expansible chamber, so that pressure fluid within the pipe string may set the packer by expanding the packing elements; and FIG. 14 is a half sectional view of the intermediate portions of the packer and pipe string, following setting of the packing elements, and repositioning of the pipe string in a position in which the port therein is in fluid communication with the test port in the mandrel for introducing test fluid into the annular space between the packing elements for testing same.

With reference now to the details of the above described drawings, and as shown in FIGS. 1 to 9, the lower end of casing within a well bore WB has been perforated opposite four vertically spaced production zones Z-1, Z-2, Z-3, and Z-4, the zone Z-1 being the lower most and the zone Z-4 being the upper most, and with zones Z-2 and Z-3 being disposed successively above the lower zone Z-1. Perforating of these zones in a multizone well, prior to the running and setting of the packers P-1, P-2, P-3 and P-4 in positions isolating the zones from one another, facilitates removal of debris from the well bore.

Figure 1:
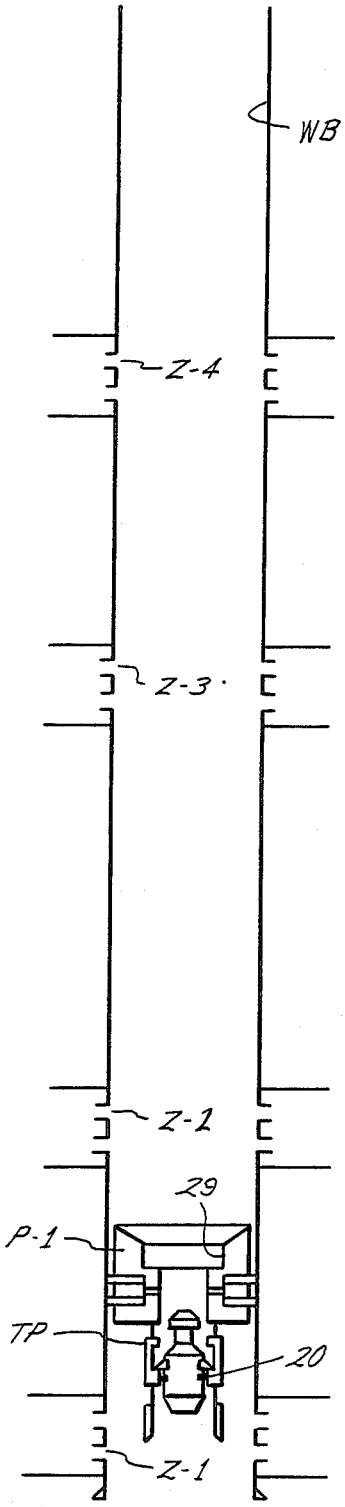
FIGS. 1 to 9 are diagrammatic illustrations of sequential steps in the completion of the above described well installation wherein the packers are individually set and then tested between adjacent pairs of vertically spaced, perforated production zones.

As shown in FIG. 1, lower packer P1 has been run and set in the well bore intermediate the perforated production zones Z1 and Z2, preferably on a wire line so as to accurately fix its elevation for sealing off the annular space intermediate zones Z1 and Z2. Having thus accurately established the elevation of the lower most packer P1, the operator is able to accurately position the second, third and fourth packers P2, P3 and P4 by connecting them to packer P1 and to one another by sections of a tubing string TS of predetermined lengths. Thus, as shown in each of FIGS. 3 to 9, when the lower end of tubing string TS is connected to packer P1, the packer P2 is disposed for sealably engaging the well bore intermediate zones Z2 and Z3, the packer P3 is disposed for sealably engaging the well bore intermediate the zones Z3 and Z4, and the packer P4 is disposed for sealably engaging the well bore above the upper most zone Z4.

Figure 2:
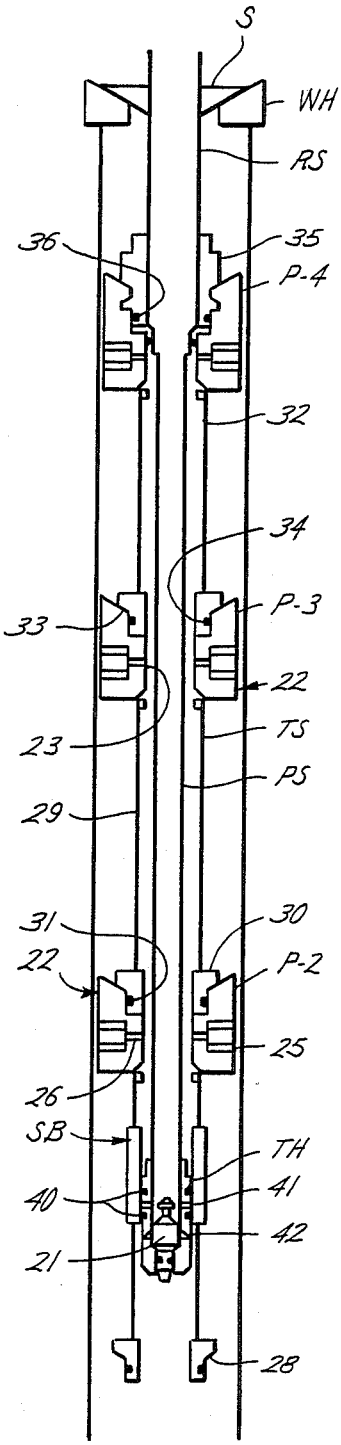
Figure 3:
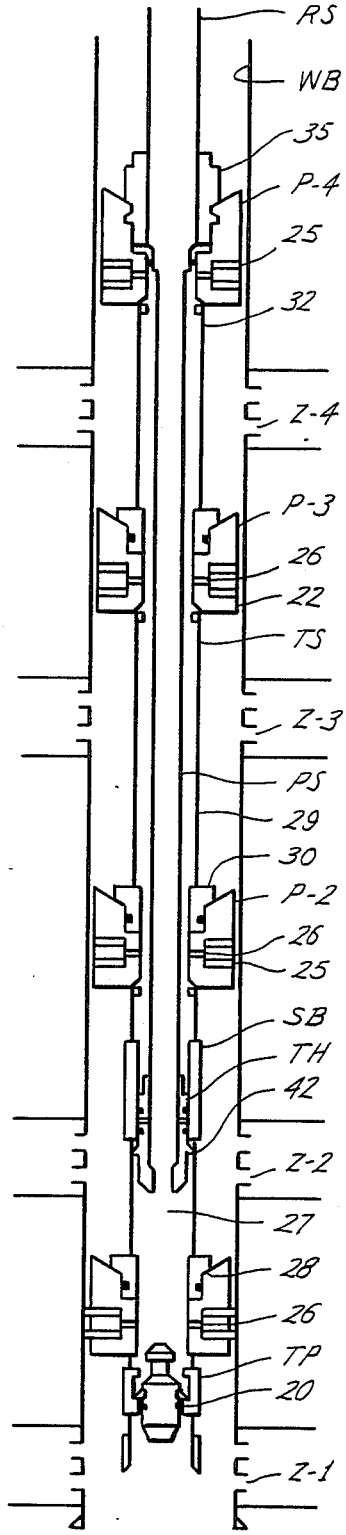

As shown in FIG. 2, the tubing sections and packers P2, P3 and P4 are supported by means of slips S at the well head WH for lowering into the upper end of the well bore with a running string RS connected at its lower end to the packer P4. More particularly, a pipe string PS is connected to the lower end of the running string beneath its connection to the packer P2 for extension downwardly through the bores of the packers P2, P3 and P4 to dispose a test head TH on its lower end within a seal bore housing SB connected in the tubing section below the packer P2. With the tubing string including the packers and pipe string have been made up, as shown in FIG. 2, the slips may be released to permit them to be lowered within the well bore and the lower end of the tubing string to be connected with the upper end of the lower most packer P1, as shown in FIG. 3.

A tail pipe TP is connected to the lower end of the packer P1 to provide a lower continuation of the tubing string TS, and a standing valve 20 is releasably supported in the tail pipe in order to hold pressure thereabove. Also, another standing valve 21 is removably supported in the lower end of test head TH to hold pressure thereabove for purposes to be described. More particularly, each of the valves 20 and 21 has a one way check valve which enables pressure fluid to be held in the tubing string TS or pipe string PS for purposes to be described, but nevertheless permits both the tail pipe and pipe string to be lowered into the positions shown. Upon removal of the valve 21 from the pipe string, as shown in FIG. 3, pressure fluid within the pipe string may be held above the valve 20 for use in testing the lower packer P1. At this time, pipe string PS is sealably engaged with the upper end of the tubing string to isolate the test pressure from the packers P2 and P3 and the test port of packer P4.

Each of the packers P2 and P3, which is of a detailed construction to be described in detail in connection with FIGS. 12A to 12C, 13A to 13C and 14, is shown in the diagramatic illustrations of FIG. 1 to 9 to comprise a body 22 having a bore 23 therethrough which, when the packers are connected in the tubing string TS, forms a continuation of the bores through the other packers and the tubing sections between them. More particularly, each such packer includes upper and lower packing elements 24 and 25 disposed about the packer body 22 in vertically spaced relation, as well as one or more ports 26 connecting the bore 23 of each packer body with the outside of the packer body intermediate the upper and lower packing elements 24 and 25. Thus, as will be described in more detail to follow, it is possible to introduce test fluid from the pipe string and into the ports prior to setting of the packer in order to test circulation through them and past the unexpanded packing elements, and then, upon setting of the packer by expansion of the packing elements, introduce test fluid into the annular space between the expanded packing elements to test their sealing engagement with the well bore. As will also be described in detail to follow, each of the packers P2 and P3 is of a construction which includes an expansible fluid chamber having a port (not shown in FIGS. 1 to 9) connecting with the bore of the packer body so that pressure fluid may be introduced from the pipe string into the chamber for setting the packer following establishment of circulation and testing of the packing elements.

Preferably, and as illustrated, each of the packers P1 and P4 is similar to packers P2 and P3 in that it also comprises a packer body 22 having a bore 23 therethrough, upper and lower packing elements 24 and 25 thereabout, and a port 26 connecting with the bore with the outside of the packer body intermediate the packing elements, whereby the packer may be tested. In other respects, however, the packers P1 and P4 differ from the packers P2 and P3. Thus, as previously described, the lower most packer P1 is set by means of a wire line, rather than by means of pressure fluid. Although the upper packer P4 may also be of such construction as to permit it to be of pressure set, it is nevertheless set by a different procedure than that which is followed in the testing packers P2 and P3. Furthermore, if desired, and since it is set above the upper most production zone Z4, the upper most packer P4 may be of more conventional construction having only a single packing element thereabout.

The tubing string TS is made up of a lower most section 27 suspended from packer P2 and having a locator sleeve 28 at its lower end received in a receptacle 29 in the upper end of the bore of the packer P1, a second tubing section 29 suspended from the packer P3 and having a locator sleeve 30 at its lower end received in a receptacle 31 in the upper end of the bore 23 through the packer P2, and a third tubing section 32 which is suspended from the lower end of the upper packer P4 and which has a locator sleeve 33 at its lower end which is received in a receptacle 34 in the upper end of the bore through the packer P3. As will be described to follow, each of the packers P2 and P3 carries means thereon for releasably connecting with the sleeve received in its receptacle. The lower end of the running string RS, on the other hand, has an anchor 35 on its lower end which is releasably connectable to a receptacle 36 in the enlarged upper bore of the upper packer P4.

As illustrated diagramatically, each such locator sleeve has a shoulder thereon for landing on a shoulder on the upper end of the packer receptacle in which it's received and a seal ring thereabout for sealably engaging the receptacle when so received. The locking elements on the sleeve 35 for releasably connecting it to receptacle 35 of packers P-4 is of any suitable, well known construction. The locator sleeves 30 and 32, on the other hand, are released from connection to the packers P2 and P3 automatically in response to setting of the packers, for a purpose and as will be described in more detail to follow.

As will also be described in detail to follow, the test head TH on the lower end of the pipe string PS in which the valve 21 is adapted to be removably mounted comprises a tubular body 40 which carries upper and lower seal means thereabout for sealably engaging within the polished bore of the seal bore housing SB when the running string RS is releasably connected to the upper packer P4. The body 40 also has a port 41 therein which connects its bore with the outside thereof intermediate the upper and lower seal means, and thus with the polished bore above the removable valve 21. As will be described to follow, pressure fluid within the pipe string PS enables the operator to be assured that the test head is sealably engaged in the seal bore housing SB, and that the pipe string holds pressure between the test head and its sealable engagement with the upper packer P4. Additionally, and as will be described in detail to follow, sealing engagement of the body within the polished bore enables pressure fluid above the valve 21 to cause locator dogs 42 carried by the test head to be released from the retracted positions of FIG. 2, wherein the test head and pipe string are free to move downwardly within the tubing string, to the expanded positions of FIG. 3 wherein the dogs are able to move upwardly through the tubing string, including the bores of the packers P2 to P4, but land on an internal seat S in each of the packers for locating the test head with respect to the bores.

Following release of the dogs 42, the valve 21 may be eetrieved and removed from the pipe string PS by means of a wire line lowered through the running string RS. This opens up the bottom of the pipe string to the tubing section 27 below housing SB, which, upon disposal of the locator sleeve 28 in the receptacle in the packer P1, forms a space above the removable valve 20 through which test fluid in the pipe string may be passed into the test ports 26 in the packer P1 for testing the sealing engagement of the packing elements 24 and 25 thereof, as shown in FIG. 3. This test fluid has of course no effect on the packers P2 and P3 on the test ports of packer since they are isolated from the test pressure. However, the packing elements 24 and 25 of the upper packer P4 may be set, as shown in FIG. 4, by increased pressure on the fluid within the pipe string which is introduced into an expansible chamber of packer through suitable ports (not shown) intermediate seal rings about the lower end of anchor 35 and upper end of the pipe string engagable, respectively, with the receptacle 36 and bore of packer P4.

Figure 4:
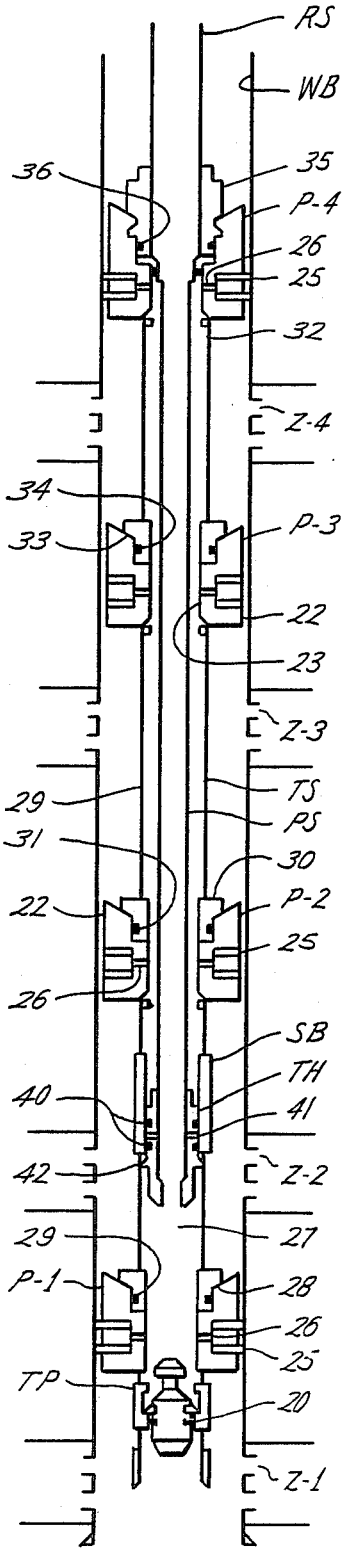
Figure 5:
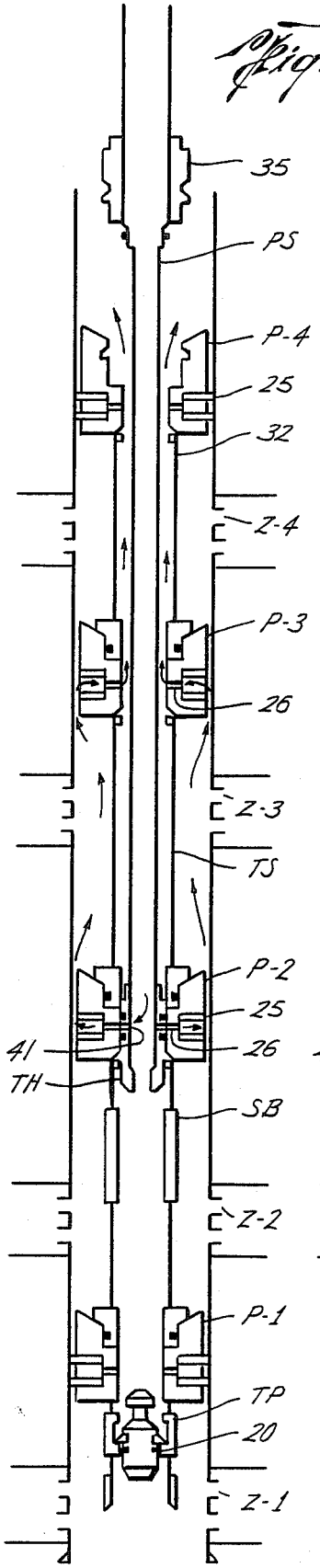
Figure 6:
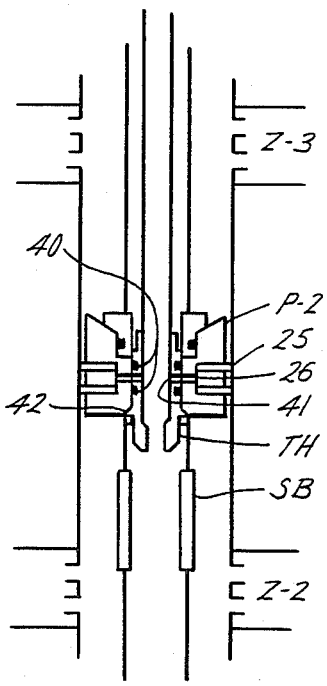

At this time, the locator sleeve 35 is released from connection to the receptacle of the upper packer P4 to permit the running string and the pipe string to be raised from the position of FIG. 4 to the position of FIG. 5. This of course opens the annular space between the bore of the upper packer and the pipe string to the well bore thereabove. It also raises the test ports and seal means of the test head from the seal bore housing SB into a position within bore 23 of packer P2 in which the ports 41 in the head are fluidly connected with the test port 26 in the packer P2. At this time, with the valve 20 removably disposed in the tail pipe TP, test fluid within the pipe string passes through the test ports in the head as well as the test ports in the packer P2, so that, as long as these test port are unobstructed, pressure fluid will then circulate upwardly past the upper, unexpanded packing element of the packer P2, past the lower packing element of the packer P3, and through the test port 26 of the packer P3 into its bore and about the pipe string PS through the bore of the packer P1, and thus into the annulus about the running string RS above the packer P4, all as indicated by the arrows of FIG. 5.

The pipe string, which has been vertically located in position for testing circulation by landing of the dogs 42 on the seat S in the packer bore, is then raised a predetermined distance so as to fluidly communicate the test port 41 in the body 40 with a port in the packer P2 leading to an expansible chamber therein. At this time, sealing engagement of the pipe string with the packer bore above and below the port leading to the expansible chamber permits pressure fluid within the pipe string to pass into the expansible chamber for expanding the packing elements of the packer P2 into sealing engagement with the well bore. The pipe string may then be moved back to the position of FIG. 6 to land dogs 42 on seat S so that the test port 41 connects with the test port 26 in the packer P2, whereby test fluid within the pipe string is caused to pass into the annular space between the expanded packing elements to test same.

Figure 7:
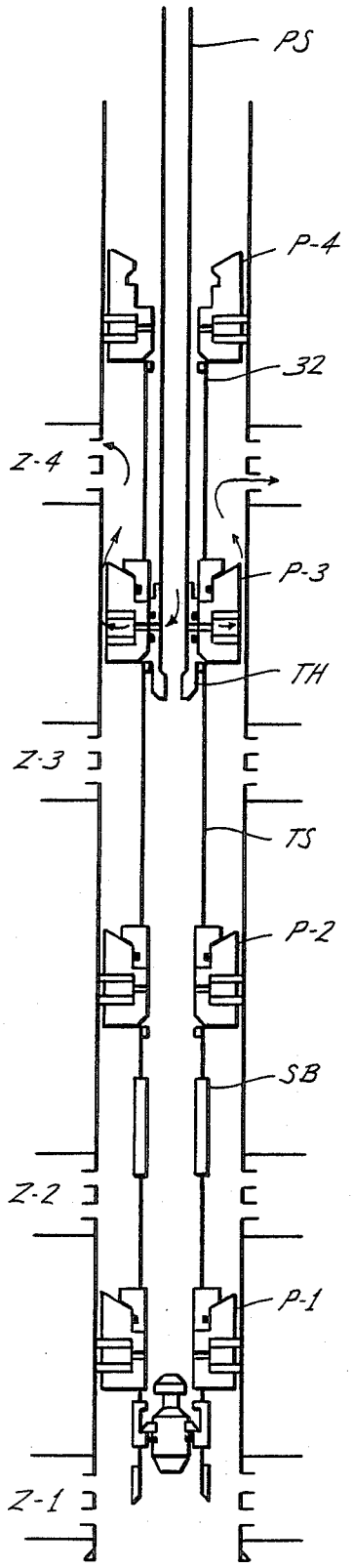

As shown in FIG. 7, the pipe string is then raised further with the running string to a position in which its test port 41 is fluidly connected with the test port 26 in the packer P3, whereby circulation through the test ports may be established, as described in connection with FIG. 5. In this case, however, since the packer P2 and the upper packer P4 are set, the pressure for testing circulation must pass into the perforated zone Z4. Thus, the operator should be careful to limit the duration of the test pressure for this purpose.

Following testing of circulation, the pipe string, which has been located in the bore of the packer P3 by landing of the dogs 42, on the seats in packer P3 is raised a predetermined distance to fluidly connect its test ports with ports leading to the expansible chamber of the packer P3, whereby packer P3 may be set in the manner described in connection with packer P2. Following setting, and again as described with FIGS. 5 and 6, the pipe string is returned to the position of FIG. 7 in which, as shown in broken lines in FIG. 8, dogs 42 land on seat S, at which time test pressure therein may be admitted to the annular space between the expanded packing elements of the packer P3 in order to test the sealing engagement of its packing element.

Figure 8:
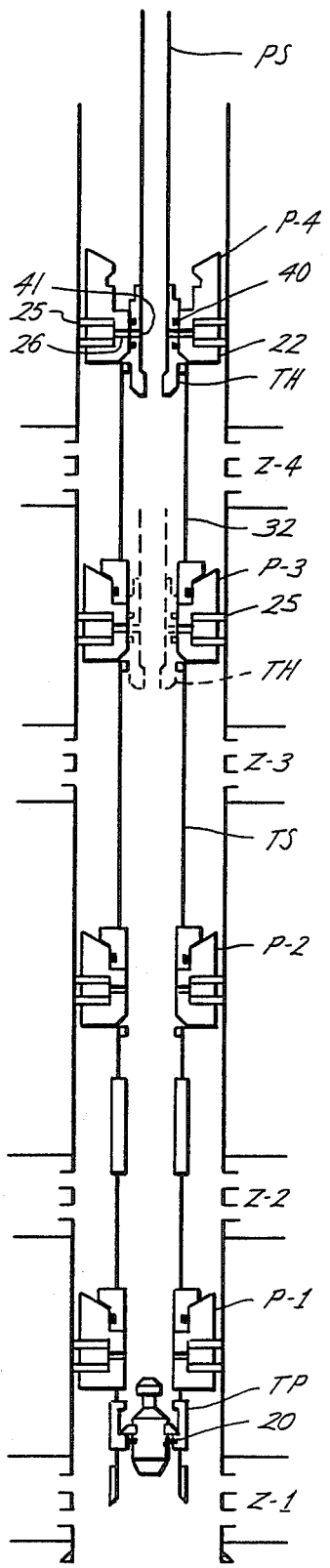
Figure 9:
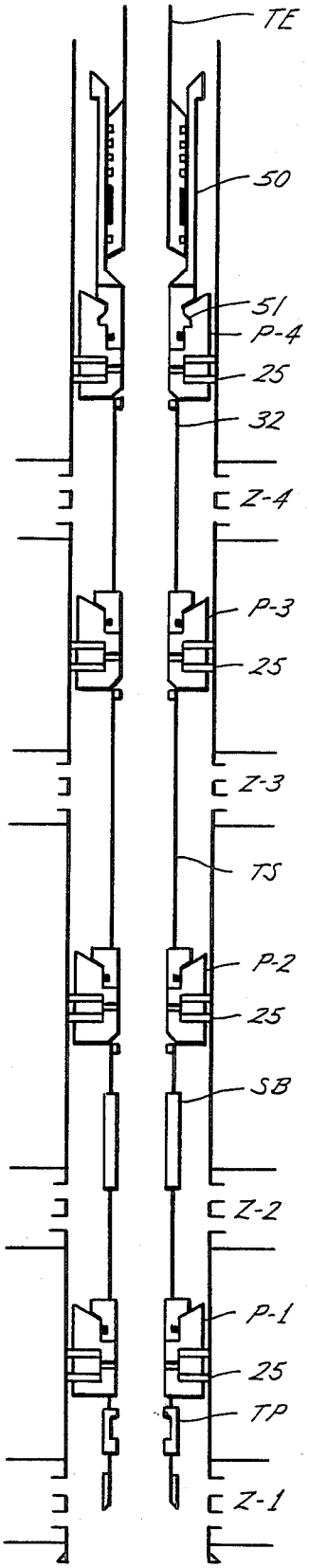

In the final phases of the completion of the well, the pipe string is again raised from the broken line position to the solid line position of FIG. 8, so as to fluidly connect the test ports in the test head body 40 with the test ports in the upper packer P4, thereby enabling the sealing engagement of its packing elements to be tested. Following this further test, the pipe string is raised from the solid line position of FIG. 8 and removed along with the running string from the well bore. A tubular extension TE have its lower end sealably disposed within the bore of a tubular element 50 is lowered with the tubular element to permit an anchor 54 on the lower end of the tubular element to be releasably connected to the the receptacle 36 in the upper end of the bore of the packer P4. Thus providing a continuous length of tubing between the tail pipe TP, and the well head. When the valve 20 is removed from within the tail pipe TP and raised to the well head for removal from the well, the well is prepared for completing one or more of the zones in addition to lower zone Z-1 by opening of the tubing sections intermediate the packers for communication with the zones Z2, Z3 and Z4.

Figure 11B:
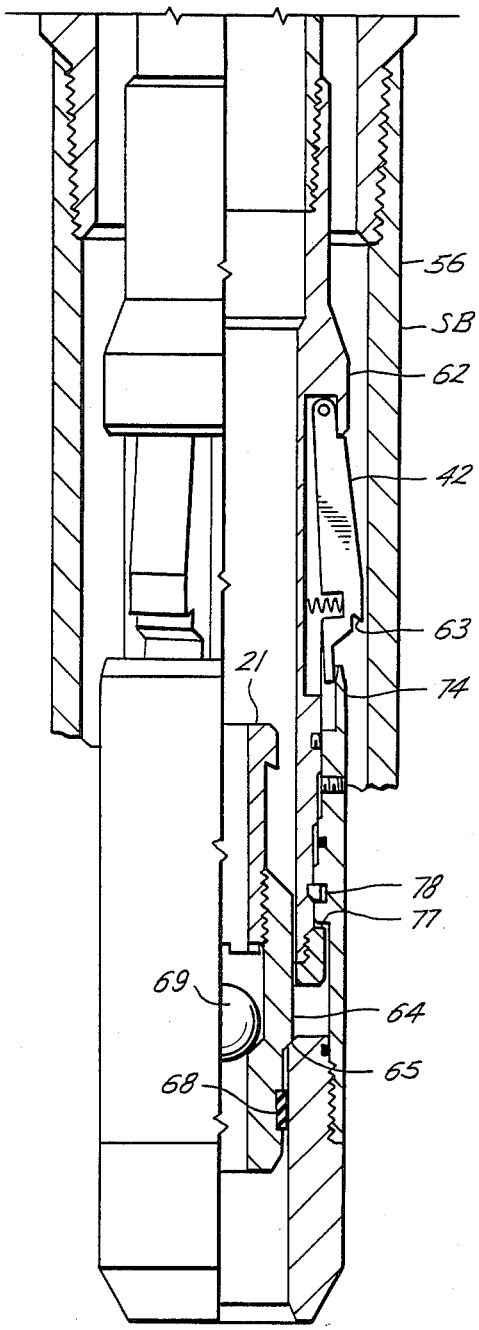
FIGS. 11A and 11B are similar views of the pipe string of FIG. 10, but showing its upper and lower ends within a seal bore housing of the tubing string, and showing the locating dogs released from their retracted positions, as shown in FIG. 4, and thus disposed for landing on an upwardly facing seat in the bore of the second packer, as shown in FIG. 5.
Figure 11A:
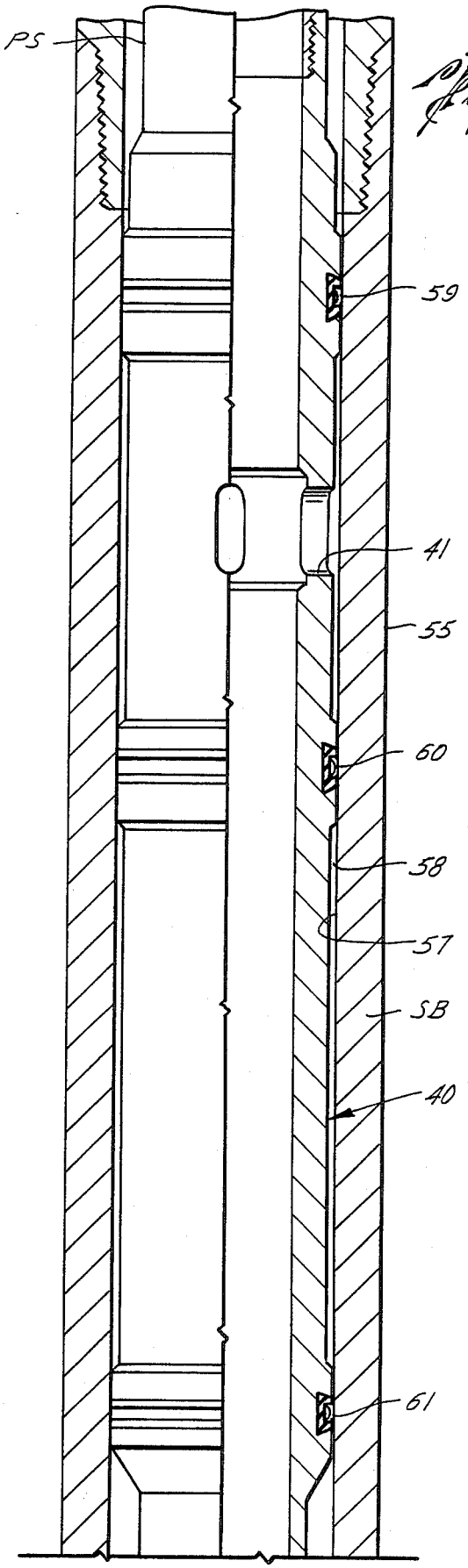

The seal bore housing SB is shown in FIGS. 11A and 11B shown to comprise upper and lower threadedly connected tubular members 55 and 56 adapted to be connected as part of the tubing section TS suspended from the lower end of the second packer P2. The upper tubular member has a polished bore 57 therein of the same diameter as the bore 23 through the packers thereabove and is so located lengthwise of the tubing string TS as to be opposite the ports 41 and seal means about the test head TH when the pipe string is suspended from upper packer P4.

As shown in FIG. 11A, the upper end of the test head comprises a tubular member 58 threadedly connected at its upper end of the lower end of the pipe string PS and having the ports 41 formed therein intermediate seal rings 58 and 60 thereabout sealably engagable with polished bore of the housing SB. An additional seal ring 61 is carried about the tubular member 58 for sealably engaging the polished bore beneath the seal ring 60, and the tubular member is imperforate intermediate the seal rings 60 and 61.

Figure 10:
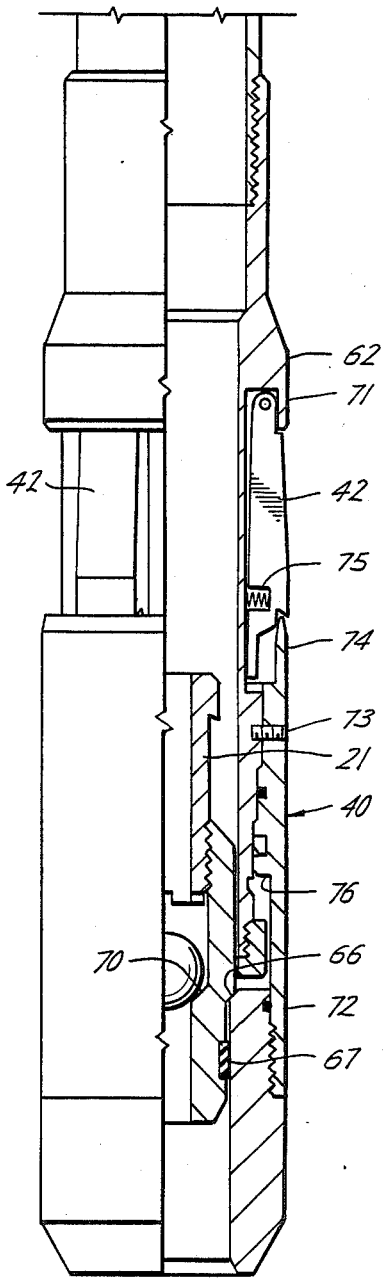
FIG. 10 is an enlarged view, partly in section, of the lower end of the pipe string and showing dogs which are mounted thereon for landing in a packer bore, and which are held in retracted positions.

The test head also includes a lower body 62 connected to and suspended from the tubular member 58 and having the locking dogs 42 pivotally connected thereto for swinging about their upper ends between retracted positions, as shown in FIG. 10, and expanded positions, as shown in FIG. 11B. When retracted, the outer sides of the locking dogs are substantially aligned with the outer diameter of the 62 so as to permit the head to be moved downwardly into the polished bore of the seal bore housing SB. However, when the locking dogs are expanded, downwardly facing shoulders 63 thereon extend outwardly from the body 62 into a position to land upon shoulders in a packer bore so as to locate the head in the bore of the packer, as will be described in more detail to follow.

As previously described, standing valve 21 is removably disposed within the lower end of the bore through the head for holding pressure thereabove while permitting movement of the head downwardly. For this purpose, the valve comprises a tubular body 64 having a shoulder 65 thereabout adapted to land on a seat 66 in the bore of body 62 and a seal ring 67 about its lower end sealably engagable with the lower end 68 of the bore through the body. More particularly, a ball 69 landed on a seat 70 within the bore of the tubular body 64 of the plug provides a one way check valve which, as above described, holds pressure from above but permits flow upwardly therethrough.

The tubular member 62 on which the dogs 42 is made up of an upper body member 71 to which the dogs 42 are pivotally connected, and a lower body member 72 releasably connected to member 71 by a shear screw 73 and on which the seat for the ball 69 is formed. The upper body member has an upwardly extending wall 74 which, when the body members are releasably connected, as shown in FIG. 10, is disposed about the dogs 42 just beneath the landing shoulder 63 thereon so as to hold them in their retracted positions. The dogs are yieldably urged outwardly by means of springs 75 so that, upon shearing the screws 73, and lowering of the member 72 with respect to the member 71, the dogs are urged outwardly to their expanded positions of FIG. 11B. Outward movement of the dogs is limited, however, by engagement of their lower ends with the inner side of the wall 74.

Downward movement of the body member 72 with respect to the body member 71 is limited by a shoulder 76 about the body member 72 adapted to land upon a seat 77 about the body member 71. As previously described, disposal of the test head within the seal bore housing, as shown in FIG. 11B, enables the operator to determine that seals and the pipe string PS thereabove hold pressure prior to introduction of pressure into the string for testing and/or setting packers. At the same time, this pressure which tests the seals and pipe string will shear the screws 73, and thus lower the body member 72 to release the dogs 42 for expansion outwardly in the position of FIG. 11B. In this latter position, the dogs permit the pipe string to be raised into the bores of successively higher packers, and the head then lowered into testing position within the packer bore upon lowering the dogs into engagement with seats in the packer bore. Body member 72 is prevented from moving upwardly by a snap ring carried on its inner diameter in position to fit within a groove 79 about body member 71, thereby preventing inadvertent retraction of the dogs 42 during subsequent downward movement of the test head.

The packer shown in FIGS. 12A–12C, 13A–13C and 14 is, for illustrative purposes, the second packer P2, although it may instead be the third packer P3, or, with modifications, the lower packer P1 or the upper packer P4. The body of the packer comprises a mandrel 80 in which the bore 23 is formed, and the receptacle 31 is formed in the enlarged upper end of the mandrel bore. Each of the upper and lower packing elements 24 and 25 disposed about an intermediate portion of the mandrel comprises upper and lower packing rings and an expander ring therebetween so that, when expanded, each such element holds pressure from above as well as below. The upper end of the mandrel is releasably connected to the locator sleeve 30 on the lower end of tubing section 29 which is located in the receptacle, while the lower end thereof is threadedly connected to tubing section 27 above the seal bore housing SB.

The packing elements are held in vertically spaced relation by means of a sleeve 81 sealably slidable along the mandrel, with packing element 24 above and packing element 25 below ports 82 formed in the mandrel when in their retracted positions of FIGS. 12A to 12C. The ports 82 are in turn fluidly connected to ports 83 formed in the spacer sleeve to provide the testing ports 26 previously referred to in connection with the diagramatic illustrations of FIGS. 1–9. Although during expansion to the positions shown in FIG. 13B, the packing elements as well as the spacer sleeve therebetween move downwardly relative to the mandrel, seals carried about the upper and lower ends of the inner diameter of the spacer sleeve are so spaced as to remain sealably engaged with the outer diameter of the mandrel above and below ports 82 in the mandrel when the packing elements are expanded, as shown in FIGS. 13A to 13C and 14.

The packer also includes upper and lower, outer tubular members which are vertically reciprocable with respect to the mandrel as well as with respect to one another and the spacer sleeve 81 so as to expand the packing elements into sealing engagement with the well bore WB in a manner to be described. These tubular members include a lower member 84 on which the lower packing element 25 is supported and an upper tubular member 85 which in turn is supported on the upper packing element 24. A slip assembly SA is disposed about the mandrel intermediate a conical expander surface 86 about the lower end of tubular member 84 and an expander surface 87 formed on the upper end of the enlarged lower end 91 of the mandrel 80. The slip assembly includes upper and lower slips 88 and 88A which have conical inner surfaces for sliding along the expander surfaces 86 and 87 in order to expand the slips into gripping engagement with the well bore upon vertical movement of the expander surfaces 86 and 87 toward one another. The slip assembly is of a construction well known in the art in which a central slip ring 89 has dovetail connections with the upper and lower slips, and the slips have dovetail connections with the expanders 86 and 87, so as to hold the slips and the slip ring about the body of the packer and interconnect them and the tubular members, whereby the packer may be released and retrieved from the well bore in response to lifting of mandrel, as will be described.

The packer is set by expansion of the packing elements into sealing engagement and the slip assembly into gripping engagement with the well bore responsive to downward movement of the upper tubular member 85 with respect to the mandrel, which in turn causes the packing elements 24 and 25 to be compressed between the tubular member 85 and the spacer sleeve and between the spacer sleeve and the tubular member 84, respectively, and thereby lowers the tubular member 84 with respect to the enlarged lower end 91 of the mandrel so as to expand the slip assembly outwardly into gripping engagement with the pipe. More particularly, the slips are expanded into gripping engagement with the pipe before the packing elements are fully expanded into sealing engagement with the well bore, and the upper tubular member is locked in its lower expanding position with respect to mandrel 80, as shown in FIG. 13B, by means of a body lock ring 90 which is carried about its inner diameter and which has ratchet teeth for ratcheting movement over ratchet teeth on the outer diameter of the mandrel.

As shown in FIGS. 12C and 13C, the lower end 91 of the mandrel is threadedly connected to tubing section 27 and releasably connected to the main body of the mandrel by means of teeth 92 on the lower end of collet fingers 93 on the lower end of the main body engagable, in the position shown in FIGS. 12C and 13C, with teeth 94 formed on the inner diameter of the lower end 91. In these positions, the teeth of the collet fingers are held in engagement with teeth 94 by means of a holding ring 95 releasably connected to the collet fingers by shear pins 96 to hold it in a position within collet fingers 93. In order to release the packer for retrieval from the well bore, a tool is lowered into the packer bore and engaged with the holding ring 85 to lift it in order to shear the pins 96 and thus free the lower ends of the collet fingers for movement out of engagement with teeth 94, following which the ring is raised into engagement with a shoulder on the main body of the mandrel so that mandrel may be raised with respect to the packing and slip expanding assembly thereabout.

The packer is adapted to be set in response to the introduction of pressure fluid into an expansible chamber 100 formed in the body of the packer intermediate the mandrel and the outer tubular member 85. Thus, as shown in each of FIGS. 12A and 13A, a ring 101 about the mandrel is sealably slidable within the inner diameter of tubular member 85 above an upwardly facing shoulder 102 on the lower end of member 85 above the packing element 24. More particularly, ports 103 are formed in the mandrel to permit pressure fluid to be introduced into the chamber 101, and thus to force the tubular member 85 downwardly with respect to the mandrel to expand the packing elements to set the packer.

As shown in FIGS. 12A and 13A, the lower end of the locator sleeve 30 which carries seal ring 105 thereabout for sealably engaging the receptacle 31 in the upper end of the mandrel. The sleeve is releasably connected to the packer by means of locking elements 106A which are carried within holes in the mandrel for radial movement between inner positions locked within a groove 106B about the sleeve and outer positions in which they release the sleeve for raising with respect to the packer. The locking elements are held in locking position, prior to setting the packer, by means of a sleeve 107 on the upper end of the tubular member 85 which surrounds the locking elements when the tubular member 85 is raised with respect to the mandrel during the setting of the packer. However, as shown in FIG. 13A, when the tubular member 85 is moved downwardly to set the packer, the sleeve 107 is lowered beneath the outer sides of the locking elements as to permit them to be cammed out of locking position in response to raising of the locator sleeve. As previously described, this automatic release of the locator sleeve from the packer enables the packers to be individually released for retrieval from the well bore.

In the event that the packer cannot be retrieved, for any reason, it is adapted to be removed from the well bore by a milling tool. As well known in the art, a tool of this type comprises an annular cutter which is moved downwardly over the upper end of the packer so as to cut away the outer portions of the packer in response to rotary movement. It may be carried on the tool lowered into the packer bore for releasing the mandrel. In any event, the spacer sleeve 81 carries a pin 110 which fits within a vertical slot 111 formed within the outer diameter of the mandrel, so as to prevent rotation of the sleeve with respect to the mandrel during a milling operation. As will be understood from a comparison of FIGS. 12B and 13B, the slot 111 is of sufficient length to receive the pin 110 in both the unset and set positions of the packer.

As shown in FIGS. 12A to 12C, the pipe string PS and in particular the test head TH on its lower end has been raised from the position of FIG. 4 within seal bore housing SB into the bore of the packer and then lowered to locate its seal rings 59 and 60 above and below the ports 82 in the mandrel so as to fluidly connect the ports 41 in the head with the ports 82, and thus with ports 83 in the spacer sleeve. With the head so located, and with valve 20 in the lower end of the tubing string, as described in connection with FIG. 5, pressure fluid may be supplied through the pipe string for circulation through the ports 41, 82 and 83. Since the packing elements are not expanded, the pressure fluid thus circulates past them and, since the lower packer P1 is set, into the annular space about the tubing string, as shown by the arrows of FIG. 5. As will be understood from the description of the packer P2, fluid is free to circulate past the lower packing elements of the third packer 83 and into and through the ports 83 and 82 therein, and then upwardly and through the annular space within the bore of the third packer P3 about the pipe string into the annulus between the tubing string and pipe string thereabove, as also illustrated in connection with FIG. 5.

The test head on the lower end of the pipe string is located in the position of FIGS. 12A–12C by the landing of dogs 42 thereon upon the seat S in the bore of the packer. As shown in FIGS. 12C and 13C, this seat is formed on the upper end of the holding ring 95, and is conically shaped for receiving the conically shaped shoulders on the lower ends of the dogs 42, thus preventing the dogs from inadvertent inward movement after landing on the seat. Thus, as also previously described, the pipe string is raised from the position of FIG. 4 to a position within the bore of the packer in which the dogs are above the seat, and thus positioned for landing on seat S, the dogs, although released, being free to slide upwardly through the pipe string in the bore of the packer until the dogs are above the seat S.

After circulation has been tested, as above described, the pipe string is raised a predetermined distance to move the seal rings 59 and 60 about the test head into positions sealably engaged with the bore of the mandrel above and below ports 103 in the mandrel. As shown in FIG. 13B, this locates the lowermost seal ring 61 on the head beneath and the intermediate seal ring 60 above the test ports 82 in the mandrel. Consequently, since the body of the head is imperforate intermediate the seal rings 60 and 61, pressure fluid which is conducted downward through the pipe string is isolated from ports 82 and 83 and is confined to pass through the ports 41 in the head and through ports 103 in the mandrel into the expansible chamber 100 in order to expand the packing elements and thereby set the packer, as shown in FIGS. 13A to 13C.

Following setting of the packer, the pipe string is again lowered to land the dogs 42 of the head on the seat S so as to again move the upper and intermediate seal rings 59 and 60 into position sealably engaging the bore of the mandrel above and below the test ports 82 in the mandrel. In this position, with the ports 83 in the spacer sleeve fluidly communicating with the ports 82 in the mandrel, pressure fluid within the pipe string is used to test the sealing engagement of the packing elements with the well bore.

Following setting and testing of the packer P2, the pipe string is raised into position for circulating past the packing elements of the third packer P3, setting the third packer, and then testing the sealing engagement of its packing elements with the well bore, as described above in connection with the packer P2.

As also previously described, the lower packer Pl may be tested by means of test fluid which is introduced through the pipe string, while the head thereof is disposed in the seal bore housing SB, as shown in FIG. 3. Thus, packer Pl is similar to packers P2 and P3 in that it has vertically spaced packing elements and a test port 26 between them, so that the pressure fluid passing downwardly through the open lower end of the pipe string is caused by the valve 20 in the lower end of the tail pipe of the tubing string to pass outwardly through the test ports. As also previously described in connection with FIG. 4, an increase in pressure within the pipe string will set the upper packer P4, which is similar to the packers P2 and P3 in that it includes an expansible chamber which may receive pressure fluid for expanding the packing elements. Thus, as shown diagramatically in FIG. 4, and as previously noted, the anchor 35 and the upper end of the pipe string PS have suitable seals for confining the increased pressure fluid within the pipe string to passage through a port (not shown) in the bore of the upper packer leading to its expansible chamber. The packing elements of the upper P4 packer may then be tested by the head on the lower end of the pipe string when the latter is raised upwardly to the position shown in FIG. 8 in which the ports 41 therein are aligned with test ports in the upper packer, as described in connection with the packers P2 and P3.

From the foregoing it will be seen that this invention is one well adapted to attain all of the ends and objects hereinabove set forth, together with other advantages which are obvious and which are inherent to the apparatus.

The invention having been described, what is claimed is:

1. A well packer for use in closing off the annular space between a tubing string and well bore intermediate perforated production zones in the bore, comprising a tubular body including a mandrel having a bore therethrough, normally retracted packing elements disposed about the mandrel in vertically spaced relation, means carried about the mandrel for expanding the packing elements into and locking them in sealing engagement with the well bore intermediate said zones, and means in the body including a test port in the mandrel connecting the mandrel bore with the outside of the body intermediate the expanded packing elements, the mandrel bore having a receptacle in its upper end to receive the lower end of a tubing section, locking elements which are carried by the mandrel for movement in and out of locking engagement with the tubing section, when so received, and means for holding the locking elements in locking position, as the packer is lowered with the tubing section into the well bore, and then releasing them to move out of locking position and thus free the tubing section to be lifted from the receptacle in response to expansion of the packing elements.

2. In a method of completing a well, the steps of installing as part of a tubing string a packer which includes a mandrel having a bore therethrough forming a continuation of the tubing string, vertically spaced; normally retacted packing elements about the mandrel, and a port in the mandrel connecting its bore with the outside of the mendrel intermediate the packing elements, lowering the tubing string into the bore of the well with the packing elements retracted to dispose the packing elements and the mandrel between them opposite and unperforated section of the well bore intermediate perforated zones in the well bore, expanding the packing elements into and locking them in sealing engagement with the unperforated section of the well bore, and conducting test fluid through the tubing string and into the port for testing the packing elements.

3. In a method of the character defined in claim 2, the further step of conducting fluid through the port prior to expansion of the packing elements.

4. In a method of completing a well, the steps of installing as part of a tubing string a packer which includes a mandrel having a bore therethrough forming a continuation of the tubing string, vertically spaced, normally rectacted paking elements, and a port in the mandrel connecting its bore with the outside of the mandrel intermediate the packing elements, lowering the tubing string into the bore of the well with the packing elements retracted to dispose the packing elements and the mandrel between them opposite an unperforated section of the well bore intermediate the areas between the tubing string and well bore which are incapable of containing pressure at a level at which the packer is to be tested, expanding the packing elements into and locking them in sealing engagement with the unperforated section of the well bore, and conducting test fluid through the tubing string and into the port for testing the packing elements.

5. In a method of the character defined in claim 4, the further step of conducting fluid through the port prior to expansion of the packing elements.

6. A production well packer for use in closing off the annular space between a tubing string and a well bore intermediate areas between the string and bore which are incapable of containing pressure at which the packer is to be tested, comprising a tubular body including a mandrel having a bore therethrough, normally retracted packing elements disposed about the mandrel in vertically spaced relation, means including a test port in the mandrel connecting the mandrel bore with the outside of the body intermediate the packing elements, means including an expansible fluid chamber and a second port in the mandrel connecting the mandrel bore with the chamber for expanding the packing elements into and locking them in sealing engagement with the well bore intermediate said areas, in response to the supply of fluid to said chamber, and a pipe string disposable within the mandrel bore and having a port therein and seal means thereabout sealably slidable within the mandrel bore and so arranged and constructed that, when the pipe string is in a first vertical position in the mandrel bore, fluid in the pipe string is confined for passage through the port therein and the test port in the mandrel in order to establish circulation through the test port, when the packing elements are retracted, and test the sealing engagement of the packing elements with the well bore, when expanded, and, when the pipe string is in a second vertical position in the mandrel bore, fluid in the pipe string is confined for passage through the port therein and the second port in the mandrel in order to expand the packing elements and lock them in sealing engagement with the well bore, the minimum inner diameter of the upper end of the bore of the tubular body and mandrel being greater than the maximum outer diameter of the pipe string so that the pipe string may be raised from within the bore of the body and mandrel for removal from the well following such test adn while the packer remains locked in sealed engagement with the well bore.

* * * * *